US006648709B2

(12) United States Patent
Teichgraeber et al.

(10) Patent No.: US 6,648,709 B2
(45) Date of Patent: Nov. 18, 2003

(54) REFLECTOR ALIGNMENT TOOL FOR PROJECTION ILLUMINATION SYSTEMS

(75) Inventors: Bryan R. Teichgraeber, Frisco, TX (US); Steven P. Krycho, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 396 days.

(21) Appl. No.: 09/745,907

(22) Filed: Dec. 21, 2000

(65) Prior Publication Data

US 2001/0031599 A1 Oct. 18, 2001

Related U.S. Application Data

(60) Provisional application No. 60/173,404, filed on Dec. 28, 1999.

(51) Int. Cl.[7] ..... H01J 9/00; H01J 9/42

(52) U.S. Cl. ..... 445/4; 445/3; 445/64; 445/63; 445/67

(58) Field of Search ..... 445/64, 63, 4, 445/3, 67, 66, 69, 61, 2; 356/153

(56) References Cited

U.S. PATENT DOCUMENTS

| | | | | |
|---|---|---|---|---|
| 3,454,810 A | * | 7/1969 | Van Cleaf | 445/4 |
| 5,032,758 A | * | 7/1991 | Davenport et al. | 313/113 |
| 5,257,051 A | * | 10/1993 | Bushroe | 353/122 |
| 5,386,257 A | * | 1/1995 | Swartwood | 352/198 |
| 6,286,219 B1 | * | 9/2001 | Palumbo, II | 33/286 |

* cited by examiner

*Primary Examiner*—Kenneth J. Ramsey
*Assistant Examiner*—German Colón
(74) *Attorney, Agent, or Firm*—Charles A. Brill; Wade James Brady, III; Frederick J. Telecky, Jr.

(57) ABSTRACT

An alignment tool (300) designed to replace a high-powered lamp with a low-powered lamp to facilitate safe alignment of a projector lamp console. The alignment tool (300) comprised of a cathode portion (302) and an anode portion (304) connected by one or more rods (306). The alignment tool holds a light source such as a flashlight (324) having an exposed bulb (320) in the approximate location of the arc of the high-powered lamp. The cathode and anode sockets and the reflector of the projector lamp console are adjusted until the exposed bulb (320) is at the F1 focal point of the reflector and the optical axis of the alignment tool is the optical axis of the reflector.

11 Claims, 3 Drawing Sheets

REFLECTOR ALIGNMENT TOOL FOR PROJECTION ILLUMINATION SYSTEMS

This application claims priority under 35 USC §119(e) (1) of provisional application No. 60/173,404 filed Dec. 28, 1999.

FIELD OF THE INVENTION

This invention relates to the field of projection display systems, more particularly to alignment of illumination systems in high-power projection display systems.

BACKGROUND OF THE INVENTION

Proper alignment of projection optical systems is critical to achieving maximum efficiency and image quality. Proper alignment ensures maximum image brightness, uniformity, and stability. Theater projection systems typically include a separate lamp console containing the lamp bulb, reflector, power supply, and cooling system. Most also include the capability of operating with one of several different lamp wattages. The projector optics must be aligned after the lamp console is installed and mated to the projector, and any time the type of bulb is changed.

Aligning the projector optics is a difficult and time-consuming process. The task is made more difficult by the intense heat and high voltage levels present in the lamp console when the lamp is operating. Additionally, the light produced by the lamp bulb—which must be viewed directly—can melt the aperture plate surrounding the glass integrating rod in the projector head if the lamp is focused on the aperture plate instead of the glass rod. What is needed is a method and apparatus to permit alignment of the projection optics without damaging the projector head or compromising the comfort or safety of the technician performing the alignment.

SUMMARY OF THE INVENTION

Objects and advantages will be obvious, and will in part appear hereinafter and will be accomplished by the present invention that provides a method and system for aligning a projection lamp console. One embodiment of the claimed invention provides an alignment tool comprising: a cathode portion, an anode portion, and a light source. The cathode portion is operable to fit into a cathode socket of the projector lamp console. The anode portion is operable to fit into an anode socket of the projector lamp console. The light source is positioned along an axis between the cathode portion and the anode portion in a position approximating the arc position of a lamp designed to fit said cathode socket and said anode socket. According to one embodiment of the disclosed invention, a flashlight is used as the light source.

Another embodiment of the disclosed invention provides a method of aligning a lamp in a projector lamp console. The method comprises the steps of: adjusting an alignment tool so that a distance between an end of the tool and a light source is equal to a distance between an end of the lamp and an arc of the lamp. Installing the alignment tool in a lamp socket in the projector lamp console. Aligning the alignment tool with an optical path of the projector lamp console, removing the alignment tool, and installing the lamp. The reflector and the lamp socket may be moved to accomplish the alignment. The alignment tool typically comprises at least two rods connecting the anode portion to the cathode portion. The alignment is facilitated by adjusting the reflector and lamp socket until a shadow from each rod is equal to the shadow from the other rods.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

A tool has been developed that enables the optical alignment of a projection console with a low-power replacement for the lamp. The tool allows the preliminary alignments to be made with the lamp power supply turned off to remove any danger to the operator or the projector head. After the rough alignment is completed, the actual lamp is installed and fine adjustments are made to the alignment using adjustment mechanisms accessible outside of the lamp console.

The alignment tool holds a low-power lamp bulb chosen to approximate the arc-length of the actual projection bulb. The krypton bulbs used in the popular Mini-Mag™ flashlights are approximately the size of the arc of most common theater projection lamps. Other types of bulbs or flashlights are available, but the Krypton bulb and the Mini-Mag flashlight are preferred because the bulb approximates the arc size of the actual lamp and because the exposure provided the bulb when the end of the Mini-Mag flashlight is removed.

The alignment tool is designed to hold the flashlight in the approximate location of the arc relative to the lamp holder. The shape and size of the tool is designed to fit into the lamp holders that hold the anode and cathode electrodes of the lamp bulb. The ends of the tool are replaceable to allow adaptation to the various electrodes of commercially available lamps.

Figure 1:
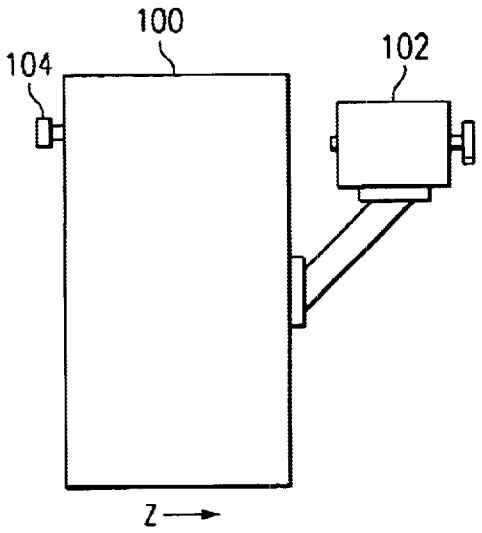
FIG. 1 is a side view of a projection lamp console and the input to a projector head according to the prior art.

FIG. 1 shows a side view of a typical projector lamp console 100 and projector head 102. The projector lamp console 100 typically includes an adjustment means 104 to allow adjustment of the lamp and reflector along a z-axis parallel with the axis of the reflector and toward or away from the projector head 102.

Figure 2:
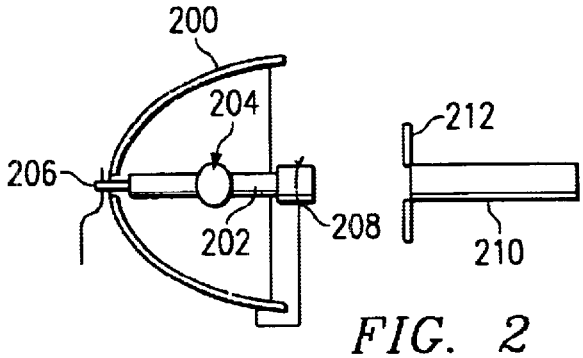
FIG. 2 is a side view of the reflector and lamp bulb of the projection lamp of FIG. 1.

FIG. 2 shows a side view of a lamp reflector 200 with a lamp 202 mounted in the reflector. When properly aligned, the body of the lamp 202 is on the axis of the reflector 200 and the arc 204 is positioned at the F1 focal point of the reflector 200. The lamp 202 is positioned relative to the reflector using an adjustable cathode socket 206 and anode support 208. Once the lamp 202 is aligned with the reflector 200, the reflector and lamp must be aligned with the projector head represented in FIG. 2 by an integrating rod 210 and an aperture plate 212.

As mentioned above, the projector console provides a convenient means for adjusting the reflector and lamp along the z-axis. Unfortunately, adjustment along the x and y axes is much more difficult. X and y axis adjustment requires the cover to be removed from the console and the lamp illuminated exposing the operator to very high voltages, heat, and illumination levels. Additionally, some of the alignment operations require the operator to directly view the light produced by the lamp. Misalignment of the projector can result in high levels of light being focused on the aperture plate in the projector head. When this occurs, the light can melt a hole in the aperture plate of the integrating optic.

Figure 3:
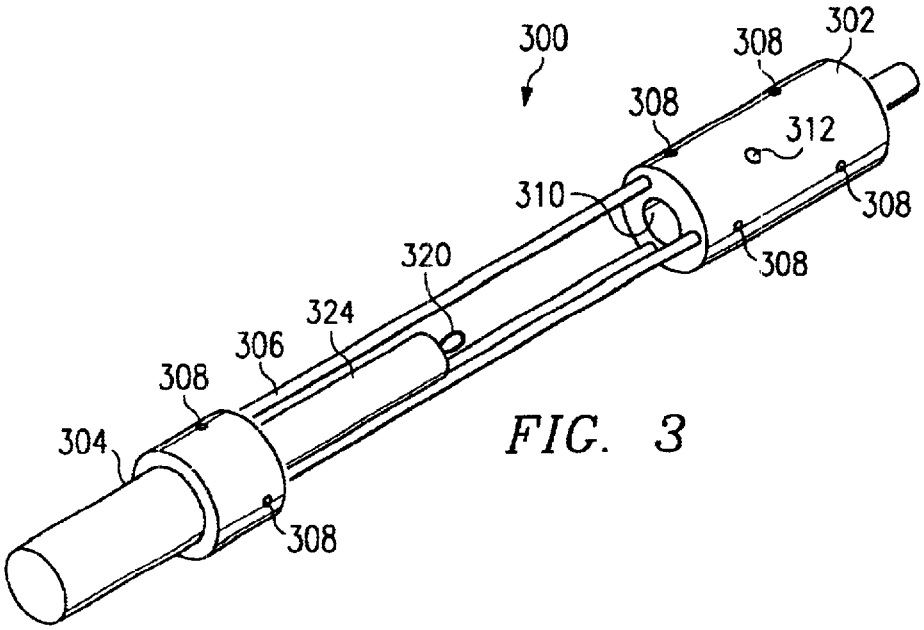
FIG. 3 is a perspective view of the disclosed alignment tool.

The new alignment tool and method described herein eliminate the need to expose the operator to the high voltage, heat, and illumination levels required in the prior art, or at least reduce the level of exposure. FIG. 3 is a perspective view of the alignment tool showing the major features of the tool 300. The tool 300 has a cathode portion 302, and an anode end 304 that are held apart by several, typically three, rods 306.

Figure 5:
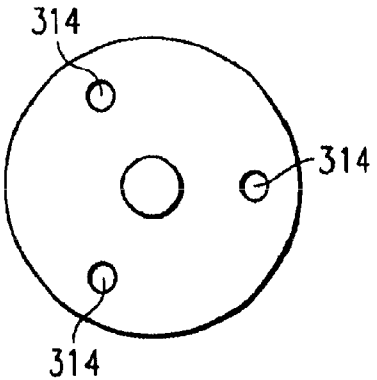
FIG. 5 is an end view of the cathode portion of the alignment tool of FIG. 3 viewed from the cathode end.
Figure 10:
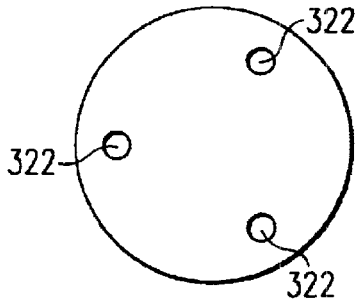
FIG. 10 is an end view of the anode end of the alignment tool of FIG. 3 viewed from the cathode end.

FIG. 5 is an end view of the cathode portion 302 shown from the cathode end of the part. The cathode portion has three through holes 314 drilled to accept the three rods 306. The three holes 314 are equally spaced around a 1.045 inch circle centered on the cathode portion 302. The embodiment shown has six holes 308 drilled and tapped into the cathode portion. The tapped holes 308 intersect the through holes 314 and are provided to allow the rods 306 to be captured in the through holes 314.

Figure 6:
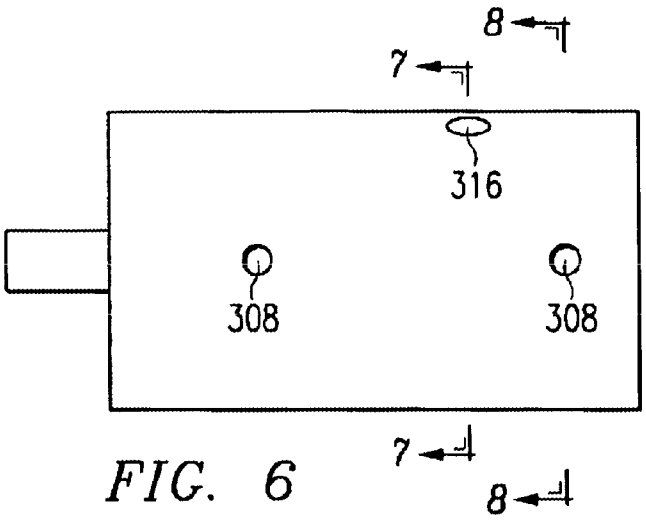
FIG. 6 is a side view of the cathode portion of the alignment tool shown in FIG. 3.

FIG. 6 is a side view of the cathode portion 302. The protrusion on the end of the cathode portion 302 allows the cathode portion to fit inside the cathode socket of the projection console. AS mentioned above, each projection console is capable of being outfitted with several types of lamps. Depending on the manufacturer of the lamp, each lamp may have a differently shaped cathode and anode. Changing the shape of the cathode and anode between models of lamps prevents a replacement lamp of the wrong wattage from accidentally being installed. To adapt the alignment tool to the various lamps used by the projection consoles, a number of different cathode and anode ends are used. Alternatively, the protrusions on the anode and cathode are made to be removable and exchanged with various sized protrusions.

Figure 4:
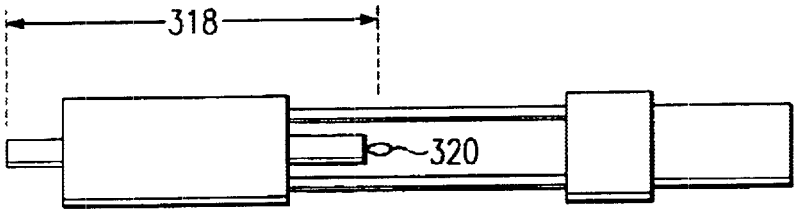
FIG. 4 is a side view of the alignment tool of FIG. 3 showing the installation of a light source.
Figure 7:
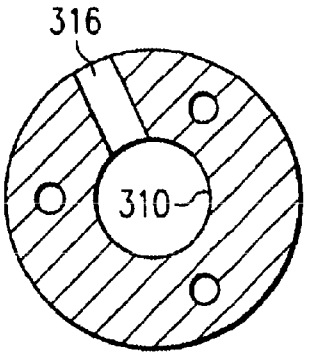
FIG. 7 is a cross-section side view of the cathode portion of the alignment tool taken along line B—B of FIG. 6.
Figure 9:
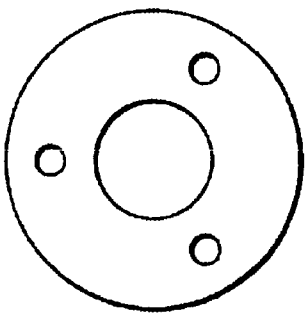
FIG. 9 is an end view of the cathode portion of the alignment tool viewed from the anode end of the tool.
Figure 8:
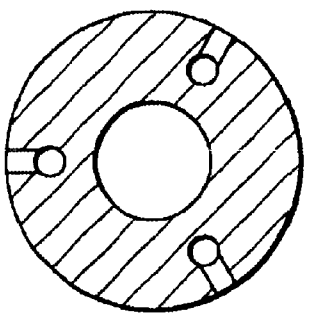
FIG. 8 is a cross-section side view of the cathode portion of the alignment tool taken along line A—A of FIG. 6.

FIGS. 7 and 8 are cross-section views of the cathode portion 302. FIGS. 6 and 7 show a threaded flashlight retainer hole 316 that allows the cathode portion 302 to hold a flashlight, 324 in FIG. 3, securely in hole 310. The diameter of the hole 310 is selected based on the type of flashlight being used to ensure the bulb of the flashlight is on the axis of the tools. Before the set screw in retainer hole 316 is tightened, the flashlight is adjusted so that the distance from the end of the cathode portion 302 to the bulb of the flashlight, shown as 320 in FIG. 4, is the same as the length between the end of the cathode and the arc of the lamp being simulated. FIG. 9 is an end view of the cathode portion 302 of the alignment tool from the anode end.

Of course, a flashlight is not necessary in all embodiments of the alignment tool 300. Other embodiments provide a light source in many other ways. For example, either the cathode portion 302 or the anode portion 304 of the alignment tool 300 is easily adapted to providing a light bulb and power source. The use of a flashlight is preferred, however, because it is readily available, simplifies the design and fabrication of the alignment tool, and provides a simple adjustment mechanism to hold the bulb at the proper distance from the cathode end 302 of the alignment tool 300.

Figure 11:
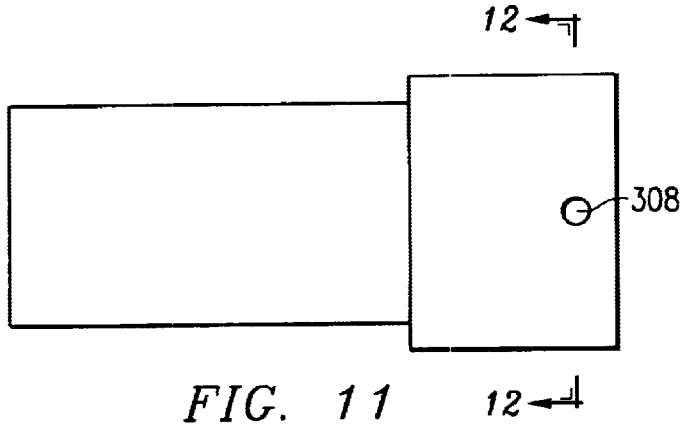
FIG. 11 is a side view of the anode end of the alignment tool shown in FIG. 3.
Figure 12:
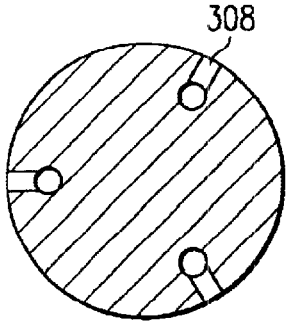
FIG. 12 is a cross-section side view of the anode end of the alignment tool taken along line A—A of FIG. 11.
Figure 13:
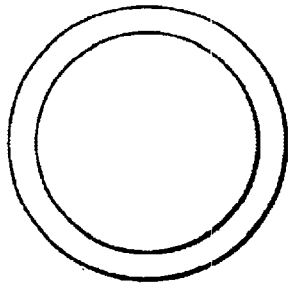
FIG. 13 is an end view of the anode end of the alignment tool viewed from the anode end of the tool.

The anode portion 304 of the alignment tool, shown in FIGS. 10–14, is of a similar design. The anode portion shown in FIGS. 10–14 uses only three tapped holes 308 to secure the rods 306, and the holes 322 from the rods only penetrate one inch into the anode portion as opposed to the through holes 314 of the cathode portion. As seen in FIGS. 6 and 11, the cathode portion 302 and the anode portion 304 of the alignment tool 300 have very different shapes. The different shapes of the cathode and anode, which are similar to the shapes of the actual lamp cathode and anode, prevent installing the alignment tool in reverse.

The cathode portion 302 and the anode portion 304 of the alignment tool are typically fabricated from aluminum. The projector console should be unplugged when using the alignment tool to prevent operational voltages from being applied to the cathode and anode sockets of the console. For additional safety, the cathode portion 302 and anode portion 304 of the alignment tool 300 are alternatively made of a non-conductive material such as Delrin.

While aluminum is used for the anode portion 304 and cathode portion 302 of the alignment tool 300, the rods 306 connecting the two end portions are typically stainless steel. Steel is used for the rods 306 to prevent the assembled alignment tool from sagging when mounted in the projection console.

To align a projection console, the alignment tool is installed in the projection console and the cathode and anode sockets are moved until the light bulb is at the F1 focal point of the reflector and the axis of the alignment tool is the axis of the reflector. The rods 306 of the alignment tool 300 each cast a shadow that assists in this alignment. When properly aligned, the shadow of the rods, as seen on an image plane near the exit aperture of the projection console, should have a uniform thickness and be the same length. When closed, the douser of the projection console provides a suitable image plane on which to focus the light from the flashlight bulb.

Once the projection console is aligned using the disclosed alignment tool, the actual lamp is installed in the reflector and ignited. Fine adjustments are then made to perfectly align the actual arc of the lamp to the reflector. As mentioned above, the position of the reflector and lamp along the z-axis—toward and away from the projector head—is easily adjusted using an adjustment mechanism provided on the projection console when the projection console is closed.

Thus, although there has been disclosed to this point a particular embodiment for a reflector alignment tool and method therefore, it is not intended that such specific references be considered as limitations upon the scope of this invention except insofar as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims.

What is claimed is:

1. An alignment tool comprising:

a cathode portion operable to fit into a cathode socket of a projector lamp console;

an anode portion connected to said cathode portion operable to fit into an anode socket of said projector lamp console; and a light source connected between said cathode portion and said anode portion, said light source positioned along an axis between said cathode portion and said anode portion and positioned relative to said cathode portion and said anode portion to approximate the position of an arc in a lamp designed to fit said cathode socket and said anode socket.

2. The alignment tool of claim 1, wherein said light source is a flashlight.

3. The alignment tool of claim 2, wherein said flashlight is held in a hole formed in said cathode portion.

4. The alignment tool of claim 2, wherein said flashlight is held in a hole formed in said anode portion.

5. The alignment tool of claim 1, further comprising at least one rod connecting said cathode portion and said anode portion.

6. The alignment tool of claim 5, wherein said at least one rod is held in said cathode portion by at least one set screw.

7. The alignment tool of claim 5, wherein said at least one rod is held in said anode portion by at least one set screw.

8. A method of aligning a lamp in a projector lamp console, said method comprising the steps of:

adjusting an alignment tool so that a distance between an end of the tool and a light source is equal to a distance between an end of said lamp and an arc of said lamp;

installing said alignment tool in a lamp socket in said projector lamp console;

aligning said alignment tool with an optical path of said projector lamp console;

removing said alignment tool; and installing said lamp.

9. The method of claim 8, said step of aligning said alignment tool with an optical path of said projector lamp console comprising the step of:

aligning said lamp socket with a reflector in said projector lamp console.

10. The method of claim 8, said alignment tool comprised of a cathode portion, and anode portion, and at least two rods connecting said cathode and said anode portions, said step of aligning said alignment tool comprising the step of:

adjusting a location of said lamp socket until each shadow formed by each of said at least two rods is straight, uniform, and of equal length.

11. The method of claim 8, said alignment tool comprised of a cathode portion, and anode portion, and at least two rods connecting said cathode and said anode portions, said step of aligning said alignment tool comprising the step of:

adjusting a reflector until each shadow formed by each of said at least two rods is straight, uniform, and of equal length.

* * * * *